US005367825A

United States Patent [19]

Döring

[11] Patent Number: 5,367,825

[45] Date of Patent: Nov. 29, 1994

[54] DOOR DRIVE OF AN UP AND OVER DOOR, SECTIONAL DOOR OR SLIDING DOOR, ESPECIALLY OF A GARAGE DOOR

[76] Inventor: Erich Döring, Im Hölzeli, CH-9442 Berneck, Switzerland

[21] Appl. No.: 3,354

[22] Filed: Jan. 12, 1993

[30] Foreign Application Priority Data

Jan. 17, 1992 [DE] Germany ..... 4201174

[51] Int. Cl.[5] ..... E05F 11/00

[52] U.S. Cl. ..... 49/199; 403/46

[58] Field of Search ..... 49/123, 197, 199, 200, 49/201, 202, 396; 403/43, 46

[56] References Cited

U.S. PATENT DOCUMENTS

| | | | |
|---|---|---|---|
| 1,256,538 | 2/1918 | Eichner | 403/46 |
| 2,588,028 | 3/1952 | McNinch | 49/199 |
| 2,885,234 | 5/1959 | Larson | 403/46 |
| 2,953,928 | 9/1960 | Anderson et al. | 49/200 X |
| 2,992,819 | 7/1961 | Jackson | 49/199 X |
| 3,481,074 | 12/1969 | Moss . | |
| 3,526,994 | 9/1970 | Delaney | 49/199 |
| 3,801,207 | 4/1974 | Herbenar et al. | 403/46 |

FOREIGN PATENT DOCUMENTS

| | | | |
|---|---|---|---|
| 7021874.5 | 6/1970 | Germany . | |
| 714774 | 9/1954 | United Kingdom | 403/46 |
| 2219039 | 11/1989 | United Kingdom . | |

*Primary Examiner*—Peter M. Cuomo
*Assistant Examiner*—Jerry Redman
*Attorney, Agent, or Firm*—Kenyon & Kenyon

[57] ABSTRACT

A door drive of a up and over door, sectional side or sectional ceiling door or sliding door, especially of a garage door, comprises at least one cylindrical guide tube supported against a ceiling or side wall, has a slide carriage arranged for movement along the guide tube, an endless traction element and a drive for opening and closing the door. The carriage is connectable with the door panel via a connecting rod. The ends of the traction element are secured together by means of a turnbuckle. For better support of the guide tube and for sampler connection or coupling of the traction element with the slide carriage, a number of mounting brackets are secured to the upper side of each guide tube for receiving support struts for mounting in the guide tube to the garage ceiling or wall. The slide carriage slides with a tubular portion along the guide tube. It has a continuous longitudinal slit on its upper side so that it can pass the brackets. The slide carriage has furthermore a lateral coupling element which can releasably be coupled with the turnbuckle. The turnbuckle comprises opposedly arranged a left-handed threads and a right handed threads, respectively, at each end for receiving anchor screws at the ends of the traction element permitting tensioning of the traction element.

6 Claims, 2 Drawing Sheets

Figure 1:
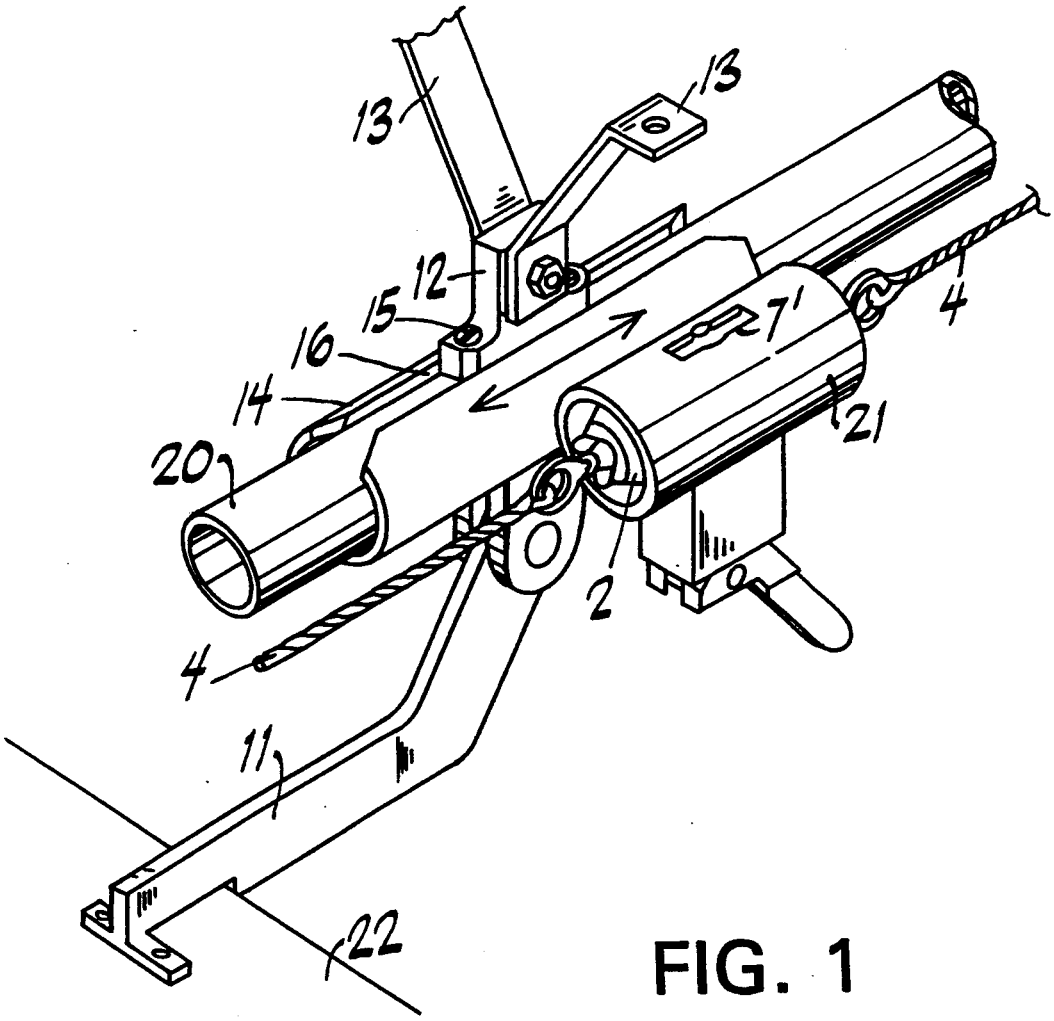

DOOR DRIVE OF AN UP AND OVER DOOR, SECTIONAL DOOR OR SLIDING DOOR, ESPECIALLY OF A GARAGE DOOR

The invention relates to a door drive of an up and over door, sectional side or sectional ceiling door or sliding door, especially of a garage door, comprising at least one multipart guide tube, preferably a multipart cylindrical guide tube, to be arranged rectangular to the upper edge of the door panel of an up and over door (overhead door) or sectional ceiling door, or rectangular to a side edge of a sidewise sliding door, running approximally parallel to the ground, supported against the garage ceiling, having a slide carriage arranged for movement along the guide tube, an endless traction element (e.g. rope, chain, belt) which is passed over two deflection elements, and a drive for the traction element for opening and closing the door by moving the carriage back and forth along the guide tube. The carriage can be connected with the traction element, and the carriage being connectable with the panel via a connecting rod, and the ends of the traction element are kept together by means of a turnbuckle.

Door drives are already known, wherein the slide carriage can be moved back and forth on one or two cylindrical guide tubes by means of a traction element, such as a chain, a rope, a V-belt or toothed belt or a band (U.S. Pat. No. 3,481,074), where the carriage totally embraces the cylindrical guide tube. For easier transport the guide tubes are subdivided into two or three sections (parts), i.e. are made of multiple parts. The parts are hollow and reduced in diameter at one end so that they can be inserted into the corresponding end of another part, similar to a tent pole. All these drives have one feature in common: the traction element has to remain slightly tensed so that it can be safely driven by the corresponding coupling element of the drive mechanism.

Apart from cylindrical guide tubes for the carriage, guide tracks with different cross sections have been known for a long time, wherein the carriage moves beneath the upper side or profile element (German utility model G 70 21 874 with I-beam guide, GB patent application 2 219 039A, with complicated profile). These sections can be mounted beneath the garage ceiling at any position of the moving range of the carriage. The sections are usually expensive and cannot be subdivided into short pieces, which can be assembled to a guide track of the required length prior to mounting. They are therefore always undivided, at least within the moving range of the carriage.

The traction element is usually tensioned by means of a turnbuckle arranged between the ends of the traction element, which this way becomes an endless traction element. It is passed over deflection rollers or the like, unless a bearing bracket of one deflection rollers is displaceable and can be fixed in a certain position by adjustment or tensioning screws.

In addition to a turnbuckle, a fixed coupling element is provided on the traction element for the slide carriage which can be connected or engaged with a corresponding coupling element, so that the slide carriage can be disengaged from the traction element, if required. The tensioning of the tractioning element by means of a turnbuckle or a adjustment screw is very complicated, time-consuming and fussy, since not only special tools, but also other deficiencies complicate the process. If the traction element is tensed too much, the guide tube is bent, especially if it is composed of different parts. The carriage is then jammed. If tension is too low the combined parts of the guide tube are deformed during the movement of certain up and over doors, which in turn affects the movement and the function of the carriage. A multitude of elements turnbuckle, tensioning elements and possibly spring elements with tensioning screws are furthermore expensive and thus increase the expense of the door drive. A multipart guide tube as well as a one-piece guide tube can only be supported at the ends of the moving range of the carriage against the garage ceiling or similar sub-constructions, since the tubular portion of the carriage totally embraces the tube (U.S. Pat. No. 3,481,074).

It is the object of the invention to improve that and to achieve a stable support of one or more cylindrical guide tubes and to obtain a turnbuckle which is easy to operate and adjust.

To solve this problem, the above-mentioned door drive provides, according to the invention, small mounting brackets fixed to the upper side of the guide tube distributed longitudinally, for receiving the support means or struts mounted to the garage ceiling, the slide carriage has a longitudinal slit on its upper side which is wide enough that it can pass the mounting brackets. The slide carriage has a lateral coupling element which can be engaged with a turnbuckle and the turnbuckle has a longitudinal hole having two oppositely arranged screw threads into each of which an anchor screw, one being a left-handed thread and the other a right-handed one, can be screwed in, the anchor screws being mounted at one end of the traction element.

Since the slide carriage has a continued longitudinal slit on its upper side, one or more cylindrical guide tubes can be supported at different positions on a longitudinal plane against garage ceiling or the like, so that even under heavy transverse loads during opening and closing of the door, bending or deforming of the guide tube is avoided. A turnbuckle being also the coupling element and which can be engaged with the slide carriage, only one component is required. If the turnbuckle is big enough (diameter 3 to 5 cm), it can be turned by hand in order to tension the traction element accordingly. Since this is done without any tool and thus without transmission, excessive tension can almost be outruled.

Preferably the turnbuckle is divided into two parts along a longitudinal center plane and at each end there is a recess for receiving a screw nut, one having a left-handed thread and one having a right-handed thread, so that, in case of damage or wear, only the screw nuts have to be exchanged. Furthermore, is it not necessary to use a tenacious material for the parts of the turnbuckle. They can be castings made of highly firm plastic material. If the turnbuckle is made of one piece, the left-handed and the right-handed thread for the anchor screws must be directly integrated into the material of the turnbuckle. Another practical feature is that the coupling element as well as the turnbuckle have an opening allowing inspection of the longitudinal hole of the turnbuckle. This way control of the space remaining for the anchor screw becomes possible so that the chain or rope can be tensed further or less.

The slide carriage can be disengaged from the turnbuckle in the known way. A connecting rod connects the carriage with the door panel.

Figure 2:
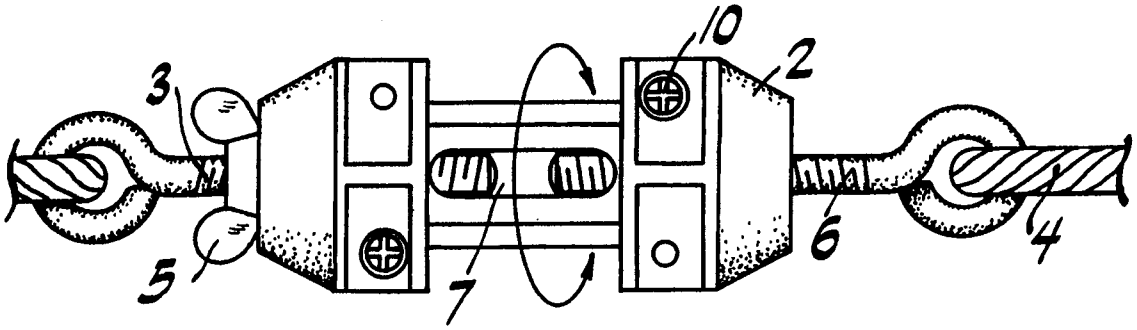
Figure 3:
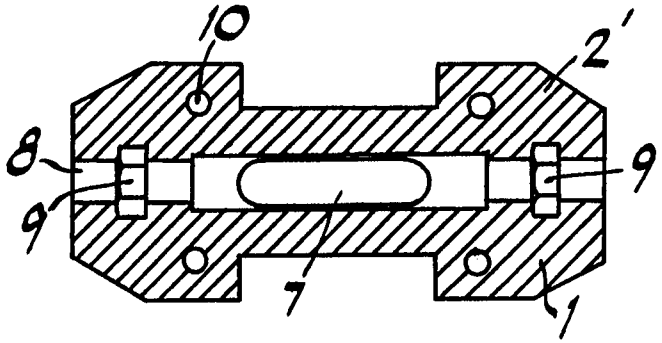

The invention will become more apparent from examination of a preferred embodiment illustrated in more detail in the drawings, which show:

FIG. 1 a guide tube with a slide carriage, a coupling element and a traction rope from an oblique view, FIGS. 2 and 3 the turnbuckle from a topview and a longitudinal cross section respectively.

The already known door drive of a garage up and over door 22, which is not described in detail, comprises at least one cylindrical guide tube 20, having one mounting bracket respectively, provided at a number of spaced apart positions the upper side of the guide tube, the brackets which are narrow in the direction of the diameter of the tube, i.e. transversely to the tube, are fastened by means of screws 15. Supporting struts 13 are screwed to the guide tube to fasten it beneath the garage ceiling. The possibly multipart guide tube 20 may be supported by means of the brackets 12 at as many positions as required to achieve stable support.

On this guide tube a slide carriage 14 comprising a tubular portion surrounding the guide tube is moved ably along its extension. This tubular portion has a continuous longitudinal slit 16 on its upper side, being wide enough (preferably approx. 10 to 15 mm) to let the carriage pass the mounting brackets 12 without colliding or friction. The slit is funnel-shaped at the ends, as well as the mounting bracket 12 and is slanted at the corresponding positions in order to ensure that the slide carriage centers itself automatically against the mounting brackets and passes them by. A tubular coupling element 21 with an internal coupling piece is mounted to one side, in FIG. 1 the front side, which can be pulled back from below against the force of a spring. On the upper side a longitudinal opening 7' is provided. This coupling element 21 is for receiving the turnbuckle 2 illustrated in greater detail in FIGS. 2 and 3 having a coupling center piece with a smaller diameter. The ends of a traction rope 4 are connected with the coupling center piece via anchor screws 3 in the form of eyebolts. The turnbuckle 2 is divided into two parts 2' along its longitudinal center plane, the lower part of which is illustrated in FIG. 3. Two such parts 2' form the turnbuckle 2 and are kept together by screws 10, refer to FIGS. 2 and 3. In the turnbuckle a longitudinal hole 8 is provided, at each end of which a thread may be cut, one being a left-handed thread and the other being a right-handed one, corresponding to the threads 6 of the anchor screws 3. The middle section of the turnbuckle 2 is smaller than its ends; this is where the coupling of the coupling elements 21 engages to drive the slide carriage 14 in either direction. On the left anchor screw 3, in FIG. 2, an eyebolt is screwed onto as a counter nut 5 to secure the anchor nut 3, which is connectable with the left front side of the turnbuckle.

In the embodiment of the turnbuckle illustrated in FIGS. 2 and 3, the thread of the anchor screws is not directly cut into the longitudinal channel, instead there are recesses in which one screw nut 9, respectively, is integrated, one being a left-handed thread and the other being a right-handed one. This way it is possible to produce the turnbuckle at a reasonable price and nevertheless use highly firm screw nuts, also available at moderate prices. This eases production as well as exchange, if required. The slide carriage is resiliently, connected with the door 22 panel via a connecting rod 11 in a known way.

The smaller center part of the turnbuckle has the opening 7' serving as a window which corresponds to an opening 7 of the coupling element 21, through which one can have a look into the central area of the longitudinal hole 8 of the turnbuckle in order to see how far the anchor screws 3 can be screwed further to tension the traction rope 4.

I claim:

1. A drive for a door, comprising:

one or more guide tubes;

a plurality of support struts for supporting each of the one or more guide tubes;

a plurality of brackets coupled to each of the one or more guide tubes, for fastening the guide tubes to the support struts;

a slide carriage disposed for movement along the one or more guide tubes, the slide carriage having in its top side a longitudinal slit of a width sufficient to bypass the brackets;

a traction element having two ends, for moving the slide carriages;

a turnbuckle for connecting the two ends of the traction element and for adjusting the tension of the traction element, the turnbuckle having two ends and a longitudinal hole with two screw threads, each screw thread for receiving an anchor screw, one anchor screw having a left-handed thread and the other having a right handed thread, each anchor screw being coupled to an end of the traction element;

a lateral coupling element disposed to the slide carriage, for coupling and uncoupling the turnbuckle to the carriage.

2. A door drive as claimed in claim 1, wherein the turnbuckle is divided into two parts along a longitudinal center plane and one screw nut is disposed near each end, one screw nut having a left-handed thread and one having a right-handed thread.

3. A door drive as claimed in claim 1 or 2, wherein the ends of the turnbuckle have a diameter of 3 to 5 cm allowing hand operation.

4. A door drive as claimed in claim 1 or 2, wherein the coupling element and the turnbuckle coupled thereto comprises an opening allowing inspection of the longitudinal hole of the turnbuckle.

5. A door drive as claimed in claim 1 or 2, wherein at least on one anchor screw a counter nut is provided.

6. A door drive as claimed in claim 5, wherein the counter nut is a butterfly nut.

* * * * *

UNITED STATES PATENT AND TRADEMARK OFFICE

CERTIFICATE OF CORRECTION

PATENT No. : 5,367,825

DATED : November 29, 1994

INVENTOR(S): E. Döring

It is certified that error appears in the above-identified patent and that said Letters Patent is hereby corrected as shown below:

Title page, item [57], col. 2,

In the Abstract, line 11, "sampler" should be --simpler--;

Column 2, line 7, after "elements" insert ",";

Column 3, line 11, "bracket" should be --bracket 12--; and

Column 3, line 12, "positions" should be --positions on--.

Signed and Sealed this

Twentieth Day of June, 1995

*Attest:*

Bruce Lehman

BRUCE LEHMAN

*Attesting Officer*

*Commissioner of Patents and Trademarks*